US008960424B1

(12) United States Patent
Anderson

(10) Patent No.: US 8,960,424 B1
(45) **Date of Patent: *Feb. 24, 2015**

(54) DISPENSING CAPSULE WITH SNAP IN ACTIVATION CHAMBER

(71) Applicant: Michael R. Anderson, Deerfield Beach, FL (US)

(72) Inventor: Michael R. Anderson, Deerfield Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/752,493

(22) Filed: Jan. 29, 2013

Related U.S. Application Data

(63) Continuation-in-part of application No. 13/478,419, filed on May 23, 2012, and a continuation-in-part of application No. 13/480,958, filed on May 25, 2012, now Pat. No. 8,839,982.

(60) Provisional application No. 61/490,971, filed on May 27, 2011, provisional application No. 61/490,920, filed on May 27, 2011.

(51) Int. Cl.
*B65D 81/32* (2006.01)
*B65D 51/22* (2006.01)

(52) U.S. Cl.
CPC ..... *B65D 51/222* (2013.01)
USPC ..... 206/222; 206/219

(58) Field of Classification Search
CPC ..... B65D 81/32; B65D 81/3211; B65D 81/3205; B65D 81/3255; B65D 51/28; B65D 51/2814; B65D 51/2857; B65D 51/2821; B01F 13/005
USPC ..... 206/222, 219, 220, 568; 215/DIG. 8; 220/521
See application file for complete search history.

(56) References Cited

U.S. PATENT DOCUMENTS

| | | | | | |
|---|---|---|---|---|---|
| 3,156,369 | A * | 11/1964 | Bowes et al. | 206/222 |
| 3,220,588 | A * | 11/1965 | Lipari | 206/222 |
| 3,347,410 | A * | 10/1967 | Schwartzman | 222/80 |
| 3,840,136 | A * | 10/1974 | Lanfranconi et al. | 215/6 |
| 3,924,741 | A * | 12/1975 | Kachur et al. | 206/221 |
| 5,029,718 | A * | 7/1991 | Rizzardi | 215/254 |
| 5,593,028 | A * | 1/1997 | Haber et al. | 206/221 |
| 6,148,996 | A * | 11/2000 | Morini | 206/222 |
| 6,305,576 | B1 * | 10/2001 | Leoncavallo | 222/83.5 |
| 7,178,683 | B2 | 2/2007 | Birkmayer et al. | |
| 7,568,576 | B2 * | 8/2009 | Sweeney et al. | 206/219 |
| 7,870,952 | B2 * | 1/2011 | Fontana | 206/222 |
| 7,951,109 | B2 * | 5/2011 | Anderson | 604/87 |
| 8,356,711 | B2 * | 1/2013 | Canziani Hoffa et al. | 206/222 |
| 2003/0213709 | A1 * | 11/2003 | Gibler et al. | 206/219 |

(Continued)

*Primary Examiner* — Steven A. Reynolds
(74) *Attorney, Agent, or Firm* — Malin Haley DiMaggio & Bowen, P.A.

(57) ABSTRACT

A dispensing capsule has a cap body having an internal recess; a chamber removably snapped into the internal recess of the cap body, the chamber including a flexible actuator and a sealing member sealing a lower portion of the chamber; and a hollow plunger slidingly disposed within the chamber, wherein a top portion of the hollow plunger engages the flexible actuator of the chamber. The flexible actuator is configured to deform and engage the hollow plunger, causing a distal end of the hollow plunger to puncture the sealing member, dispensing an ingredient stored in the chamber. The distal end of the plunger may have a beveled cutting surface. The chamber includes two circumferentially disposed races defining an annular groove, wherein an annular protrusion in the internal recess of the cap body removably engages the annular groove of the chamber.

10 Claims, 5 Drawing Sheets

(56) References Cited

U.S. PATENT DOCUMENTS

| | | | | |
|---|---|---|---|---|
| 2005/0007870 | A1* | 1/2005 | Faraldi et al. | 366/130 |
| 2008/0142473 | A1* | 6/2008 | Cho | 215/252 |
| 2008/0202950 | A1* | 8/2008 | Anderson | 206/219 |
| 2010/0163442 | A1* | 7/2010 | Lee et al. | 206/222 |
| 2010/0187257 | A1* | 7/2010 | Roth et al. | 222/129 |
| 2011/0174642 | A1* | 7/2011 | Coon | 206/222 |
| 2011/0266171 | A1* | 11/2011 | Rovelli | 206/222 |
| 2012/0193362 | A1* | 8/2012 | Porter | 220/521 |

* cited by examiner

DISPENSING CAPSULE WITH SNAP IN ACTIVATION CHAMBER

CROSS REFERENCE TO RELATED APPLICATIONS

This application is a continuation-in-part of co-pending U.S. patent application Ser. No. 13/478,419 filed May 23, 2012, which claims priority to U.S. Provisional Patent Application Ser. No. 61/490,971 filed May 27, 2011. This application is also a continuation-in-part of co-pending U.S. patent application Ser. No. 13/480,958 filed May 25, 2012, which claims priority to U.S. Provisional Patent Application Ser. No. 61/490,920 filed on May 27, 2011.

STATEMENT REGARDING FEDERALLY SPONSORED RESEARCH OR DEVELOPMENT

N/A

BACKGROUND OF THE INVENTION

1. Field of the Invention

The present invention generally relates generally to dispenser capsules for various ingredients and more particularly to a chambered dispensing capsule having snap in activation chamber comprising a flexible button blast for use on a variety of containers and in conjunction with a variety of ingredients.

2. Description of Related Art

Most if not all liquids, creams, gels and even certain powders and other substances are formulated and created for the longest shelf life and not necessarily for optimal performance and/or usefulness. There are many ingredients and/or combinations of ingredients that have reduced shelf life due to requiring combinations of liquid substances. In most all cases when any ingredients are exposed to one another, including air, deterioration begins and the clock on the limited shelf life starts. Also in most products in any category, "Shelf Life" is the key factor with respect expiration dates based on the product and category.

Several attempts have been made to design capsules and containers to improve the shelf life of compositions such as gels, liquids, powders and the like however the majority of the available devices rely on a plurality of interconnected parts which are not cost effective to manufacture and assemble. The present invention is designed to be inexpensive to mass produce, fill and seal to be able to deliver an affordable dispensing capsule in virtually any application and category. This invention allows formulas and new products in any categories to be invented and made for desired end effects and not for what has to be done do to normal packaging and manufacturing and eliminating many unhealthy ingredients that are currently and normally used to produce most products. The present invention, therefore, is useful for packaging ingredients such as enzymes, calcium and magnesium with bio flavinoids vitamin C, probiotics creatine and many more.

Moreover, most of the dispensing capsules in the prior art comprise uni-body rigid designs that increase manufacturing costs and can be somewhat difficult to activate due to the need for a rigid material to engage a container without breaking or disassembling. The use of these rigid materials can render certain dispensing actuators difficult to depress or use because the single-material design. Accordingly, the present invention solves this problem and is particularly useful because it includes a snap in activation chamber that is configured to engage a cap body wherein the body and the chamber can comprise different materials in order to improve manufacturing, storing, and utility capabilities of the invention. These and other improvements described below also provide a substantial improvement over the prior art with respect to shelf life and overall versatility.

It is, therefore, to the effective resolution of the aforementioned problems and shortcomings of the prior art that the present invention is directed. However, in view of the container and dispensing capsules and related devices in existence at the time of the present invention, it was not obvious to those persons of ordinary skill in the pertinent art as to how the identified needs could be fulfilled in an advantageous manner.

SUMMARY OF THE INVENTION

The present invention comprises various embodiments of a dispensing capsule. In some embodiments, the dispensing capsule comprises a cap body having an internal recess; a chamber removably snapped into the internal recess of the cap body, the chamber including a flexible actuator and a sealing member sealing a lower portion of the chamber; and a hollow plunger slidingly disposed within the chamber, wherein a top portion of the hollow plunger engages the flexible actuator of the chamber. The flexible actuator is configured to deform and engage the hollow plunger, causing a distal end of the hollow plunger to puncture the sealing member, dispensing an ingredient stored in the chamber. The distal end of the plunger may comprise a beveled cutting surface.

In some embodiments, the cap body includes internal threads configured to threadably engage a container. Further, in some embodiments, the flexible actuator comprises a bellow-type actuator. In some embodiments the hollow plunger includes a nozzle at a top portion thereof, and further includes one or more aeration openings. A cover may be removably received on the cap body and in some embodiments the cover is hingeably attached to the cap body.

To provide the snap-in feature, the chamber includes two circumferentially disposed races defining an annular groove, wherein an annular protrusion in the internal recess of the cap body removably engages the annular groove of the chamber. This allows the chamber and flexible actuator to be manufactured separately from the cap body and therefore they can be comprised of a softer material than the cap body, providing for easier actuation of the device while maintain a durable engagement of the cap body with a container, such as a bottle.

Accordingly, it is an object of the present invention to provide a dispensing capsule that comprises a snap in chamber allowing for differences in material hardness with respect to the chamber and the cap body, in order to provide easier activation of the capsule.

It is another object of the present invention to provide a versatile dispensing capsule that can be used in conjunction with a plurality of containers and dispense an ingredient contained therein in an easy and efficient manner.

In accordance with these and other objects which will become apparent hereinafter, the instant invention will now be described with particular reference to the accompanying drawings.

DETAILED DESCRIPTION

Figure 1:
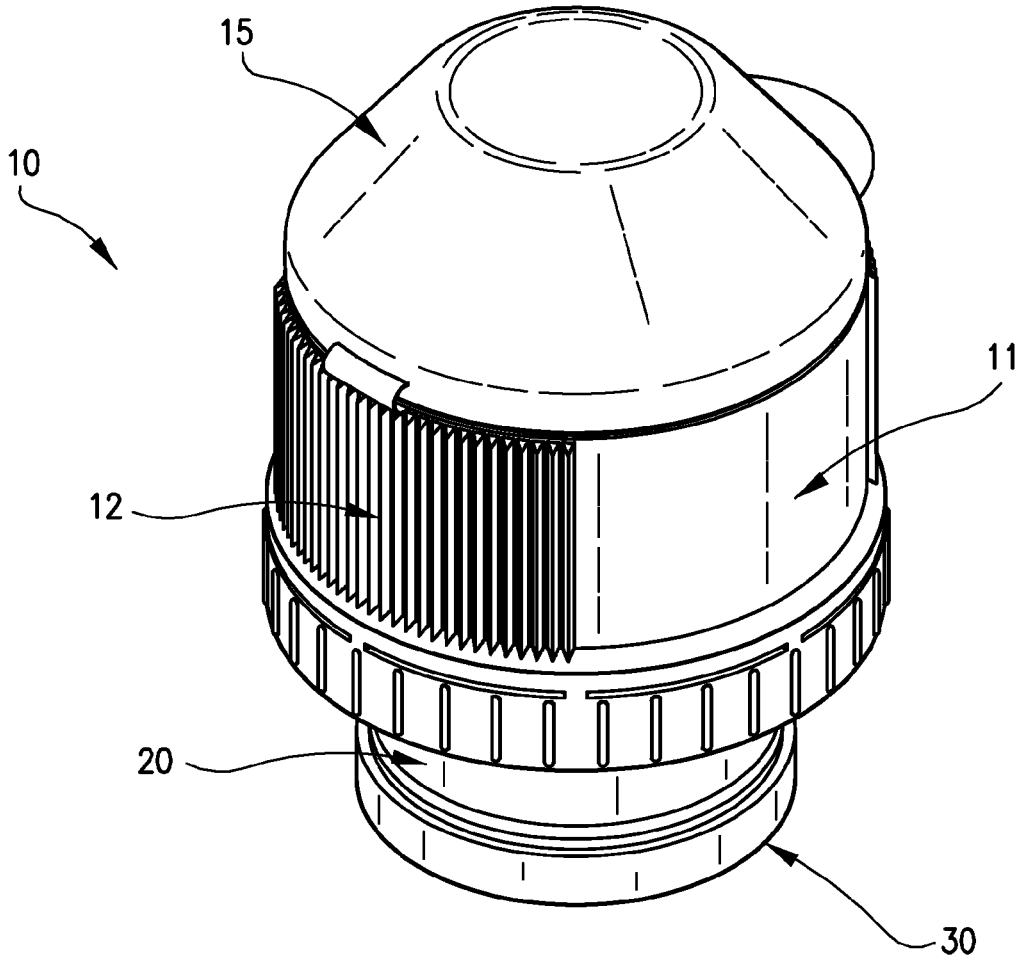
FIG. 1 is a perspective view of one embodiment of the dispensing capsule of the present invention in an assembled state.

With reference FIGS. 1-6, the dispensing capsule generally comprises a cap body 10 having an internal recess 11, a snap-in chamber 20 having received therein a slidingly disposed plunger 21, and a sealing member 30. With reference to the cross-sections shown in FIGS. 4-6, in some embodiments, the cap body 10 includes a manual gripping area 12 on the outside thereof and internal threads 13 within the internal recess 11 thereof. The internal threads 13 are adapted to threadingly engage a container, such as a bottle, IV bag, or the like as further shown and described as container 40. In some embodiments, also provided within the internal recess 11 of cap body 10 are one or more annular protrusions 14 which are provided around the internal circumference of the cap body. In some embodiments, a single annular protrusion 14 is provided and is configured to engage the snap-in chamber 20 as further described. In some embodiments, also provided over the top portion of the cap body 10 is a cover 15 which may be hingeably attached to cap body 10 by hinge or other similar structure allowing the cover 15 to be retained on the cap body 10 but also be selectively opened and closed by the user to access the snap-in chamber.

Figure 2:
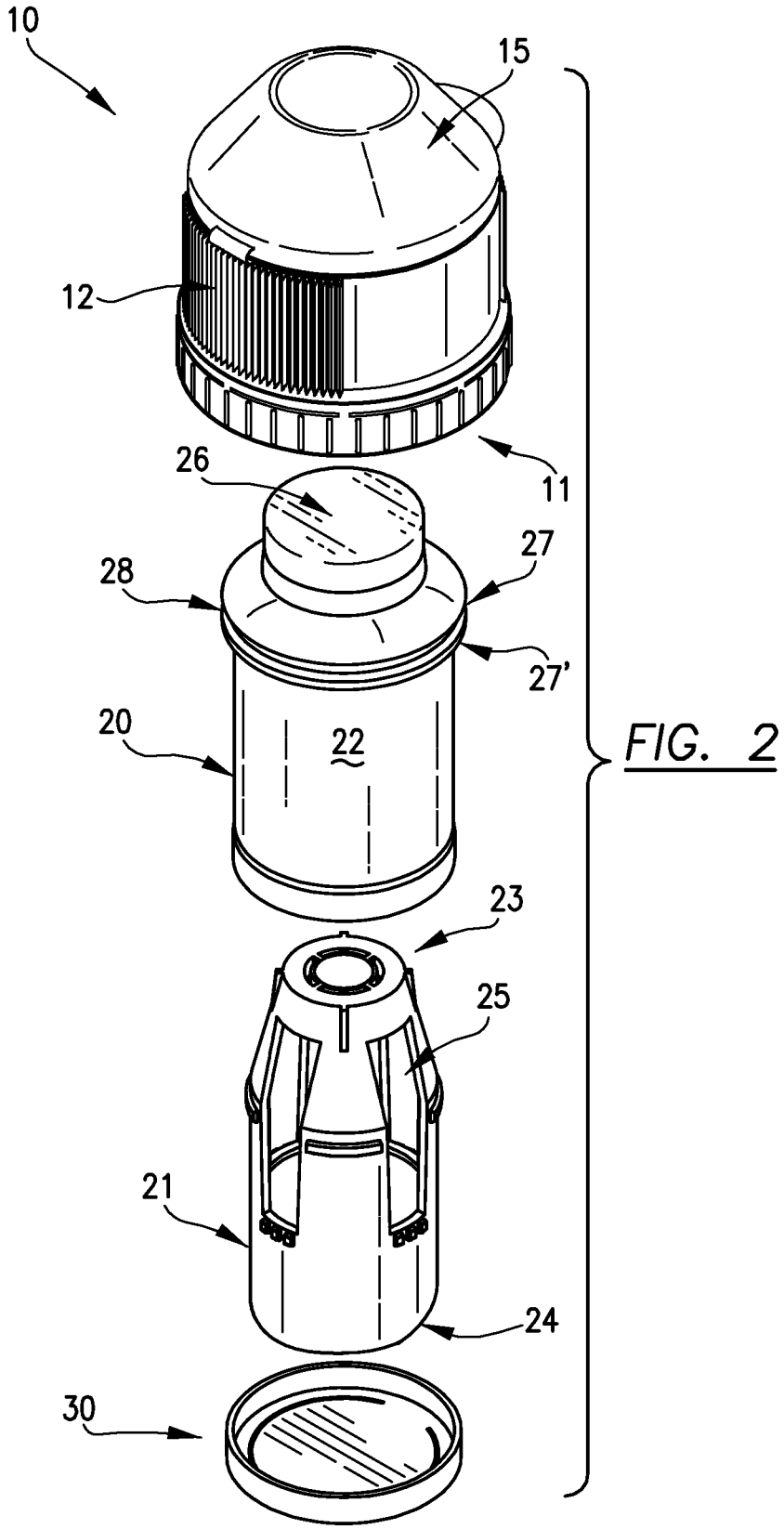
FIG. 2 is an exploded view of one embodiment of the dispensing capsule of the present invention depicting the various components thereof.
Figure 3:
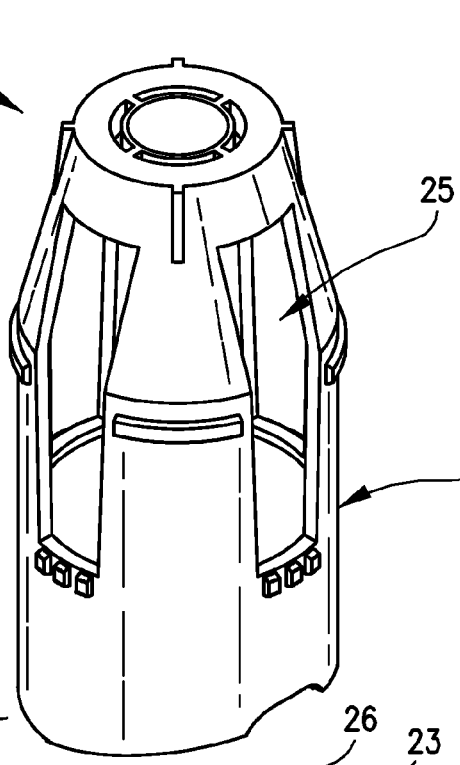
FIG. 3 is a perspective view of one embodiment of the plunger aspect of the present invention.
Figure 4:
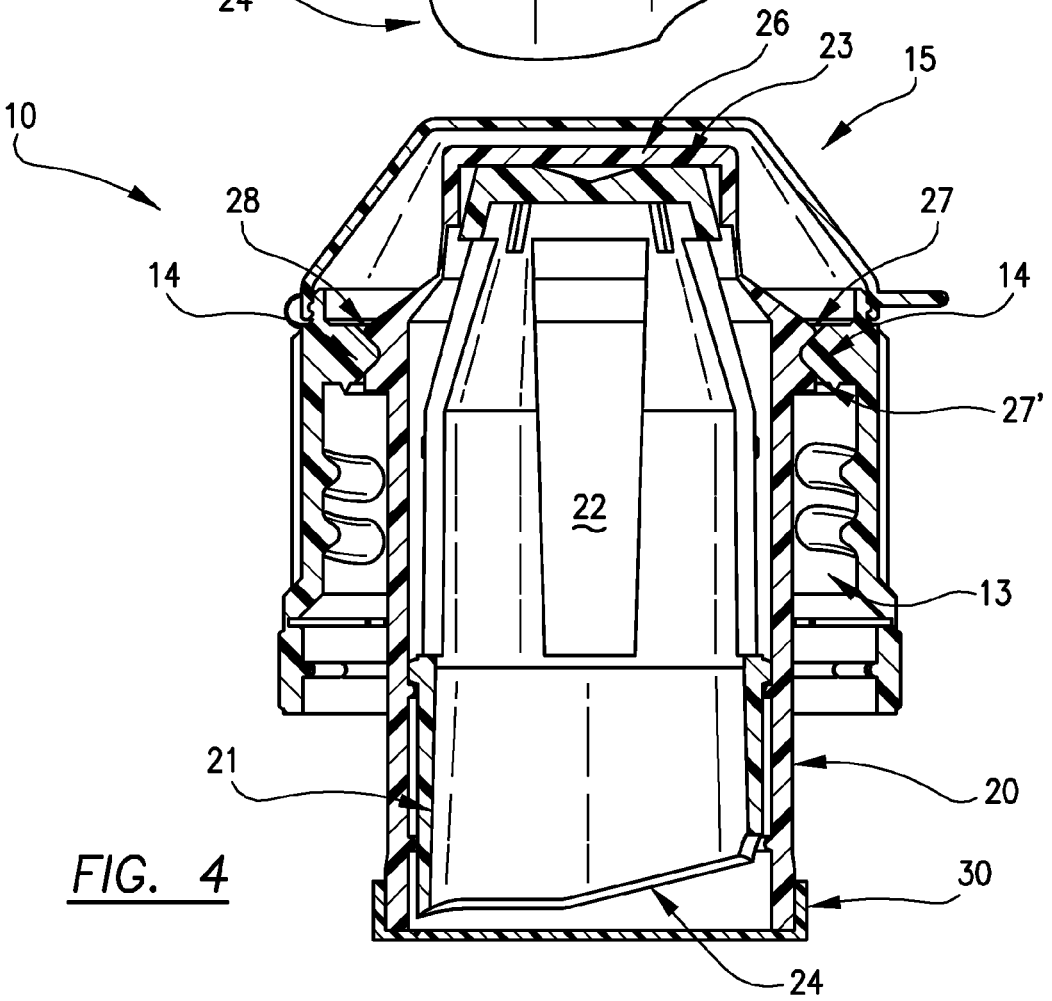
FIG. 4 is a cross-sectional view of one embodiment of the present invention.

Shown best in FIG. 2, the snap-in chamber 20 comprises a hollow ingredient storage space 22 that is configured to slidingly receive plunger 21. In some embodiments, plunger 21 is hollow and includes an upper nozzle 23 and a lower cutting surface 24 which, in some embodiments, is defined by an angling or beveling of the distal end of the plunger 21. The nozzle 23, in some embodiments, comprises a tapered protrusion configured to engage the inside of the snap-in chamber 20. The upper portion of the plunger 21 may, in some embodiments, include one or more aeration openings 25 which prevent the trapping of air inside the chamber 20 during operation.

The top portion of the snap-in chamber 20 comprises a flexible actuator 26 which may comprise a bellow or stepped-blast type actuator 26 comprised of a rubber, plastic, or combinations thereof and other like materials. Plunger 21 is configured such that it is accommodated by the matching internal dimensions and configuration of the storage space 20 of snap-in chamber 20, including the nozzle 23. In some embodiments, the top portion of the plunger 21 including nozzle 23 thereof extends into the snap-in chamber 20 such that it is adjacent underside of the flexible actuator 26.

Figure 6:
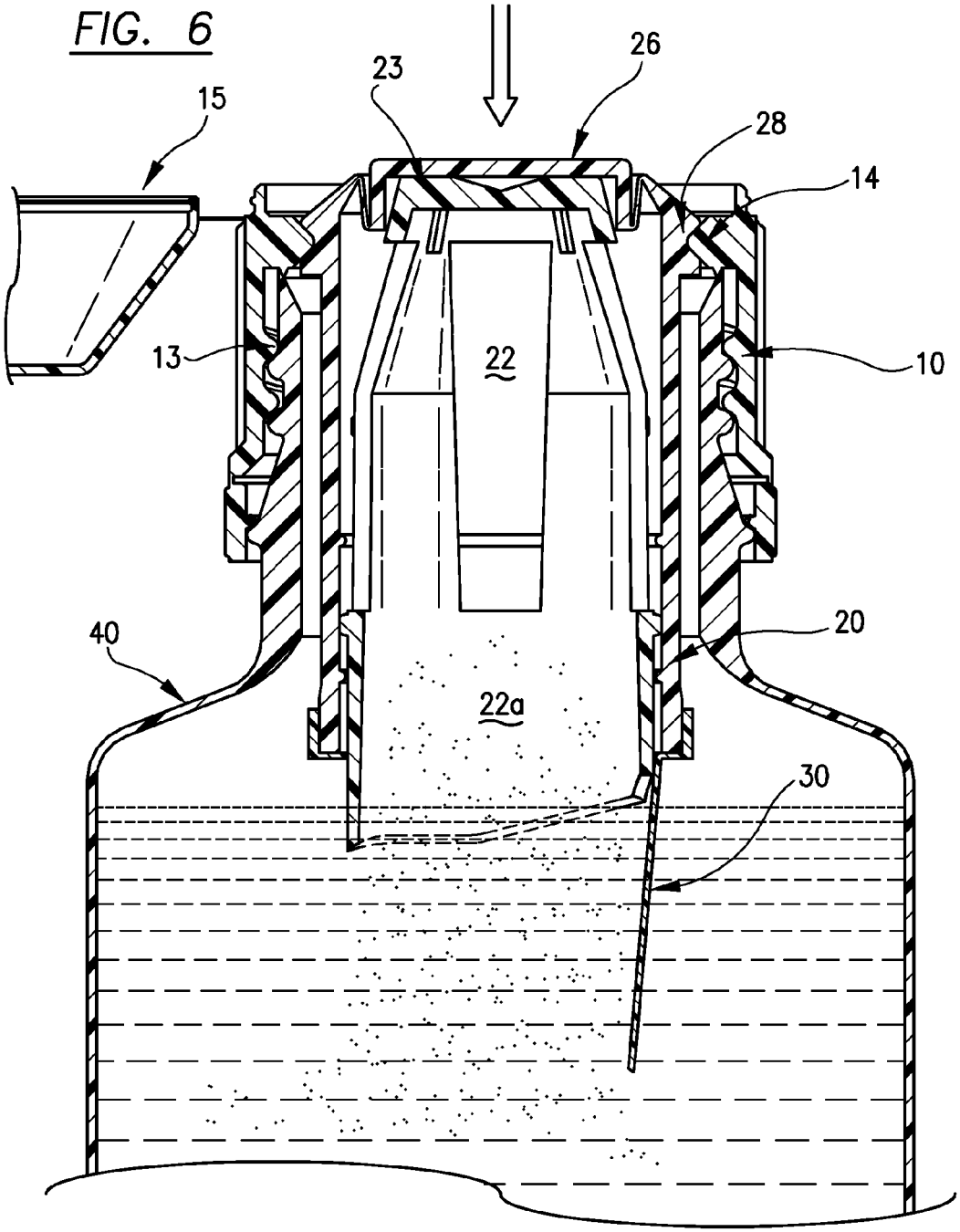
FIG. 6 is yet another cross-section view of one embodiment of the present invention, shown in an activated state.

As noted above, the lower end 24 of plunger 21 may comprise an angle-cut configuration in order to provide a means to break or pierce the sealing member 30 during activation of the device as shown in FIG. 6. Accordingly, the sealing member 30 is attached around a bottom portion of the chamber 20, at the bottom periphery thereof and therefore seals the storage space 22 in order to contain one or more ingredients therein until the device is actuated. Further, because plunger 21 is initially disposed completely within storage space 22 of the chamber 21, the sealing member 30 also seals plunger 21 therein.

In some embodiments, as shown in FIG. 2 and FIGS. 4-6, disposed towards the upper portion of the snap-in chamber 20 are two circumferentially disposed races 27 and 27' which define a hollow annular groove 28 circumferential disposed around the chamber 20. Accordingly, snap-in chamber 20 is configured to be removably received inside cap body 10 whereby the annular protrusion 14 of the cap body engages and snaps into annular groove 28. This two piece construction provides for easier manufacturing of the present invention and also permits the snap-in chamber 20, including the flexible actuator 26 to be comprised of a relatively softer material as compared to the cap body 10. This allows the cap body 10 to be more durable and resilient when engaging a container such as bottle, while also improving the ease of which the relatively softer button actuator is activated. Thus, no compromise between structural rigidity and ease-of-use has to be made.

Figure 5:
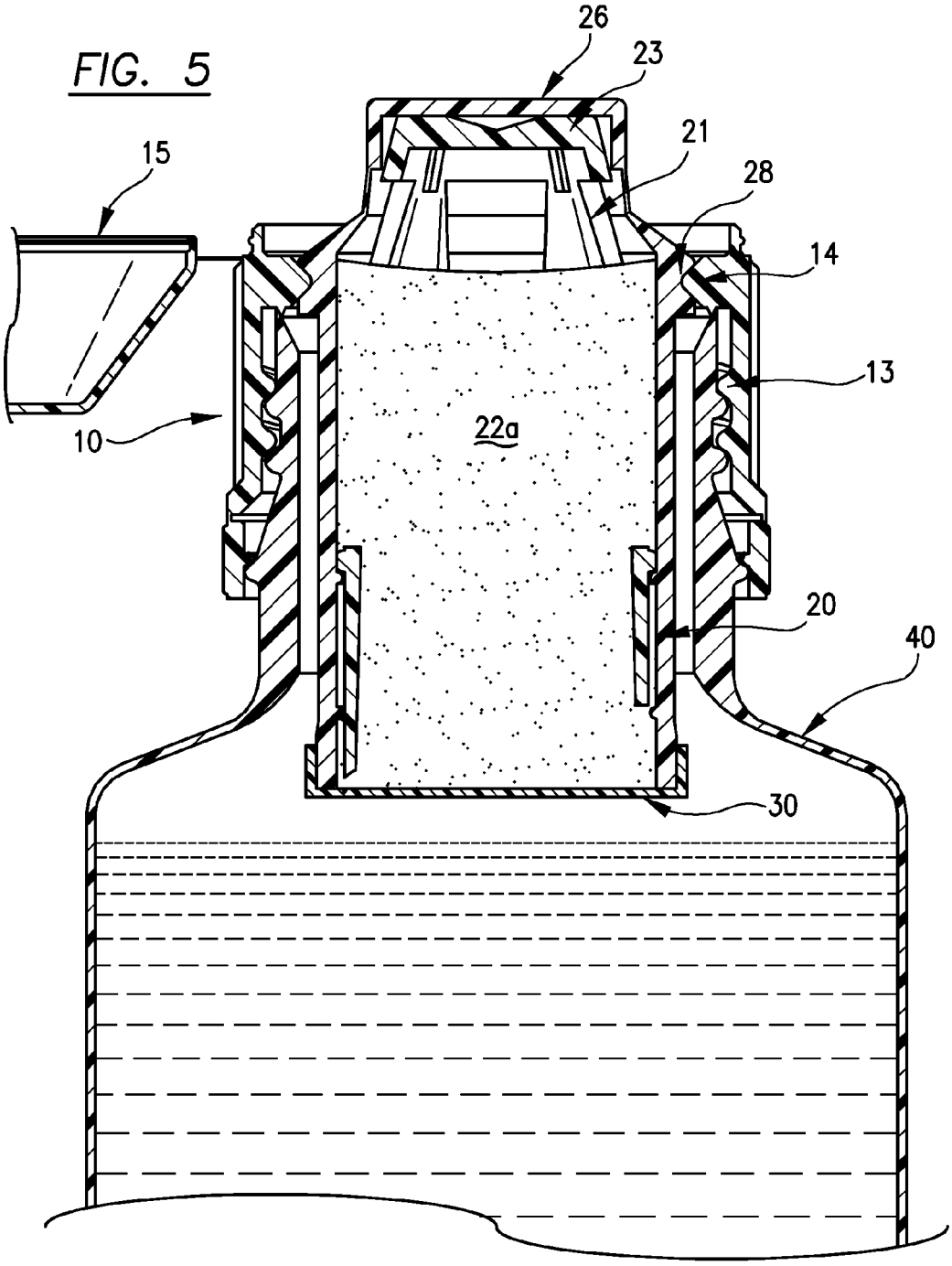
FIG. 5 is another cross-sectional view of one embodiment of the present invention.

With reference to FIG. 5, the dispensing capsule of the present invention is configured to store a first ingredient **22*a* within the storage space 22 of snap-in chamber 20, which chamber is initially sealed at the bottom by sealing member 30 and with hollow plunger 21 also disposed within snap-in chamber 20. The snap-in chamber is snapped into the cap body 10 which cap body 10 may be screwed onto or otherwise provided onto a container 40 whereby, in some embodiments, the cap body 10 threadably engages the container 40 by way of internal threads 13. In other embodiments, the cap body 10 may engage container 40 by a snap fitment or other structure. In some embodiments, with the cap body 10 attached to a container 40, at least a portion of the chamber 20 will be disposed down into the container, or a neck portion 41** thereof.

With reference to FIGS. 5-6, the capsule is configured to selectively dispense the first ingredient **22*a* from the chamber 20 by depressing the flexible actuator 26 in a downward fashion. As the actuator 26 deforms and travels downward (shown by the double-lined arrow in FIG. 6), it will engage and apply downward pressure onto the top portion of hollow plunger 21, at the 23. The continued downward pressure will cause plunger 21 to displace downward at least until the distal end 24 of plunger 21 breaks or punctures sealing member 30. Once the sealing member 30 is broken, the first ingredient 22*a* will be dispensed from chamber 20. In some embodiments, the capsule is attached to a container 40 and therefore the first ingredient 22*a* will dispense downward into the container to, for example, be mixed with another ingredient contained in the container. In some embodiments, the hollow plunger 21 is resilient retained within the storage chamber 22 to prevent the hollow plunger 21 from dislodging from the dispensing capsule during operation. It is further appreciated that in the case of a bellow step-type actuator 26**, the actuator may resilient return to its starting position after activation.

It is appreciated that the capsule of the present invention can comprise any combination of materials including plastics, rubbers, aluminum, resins, and the like. With this, as noted above, in some embodiments it is desirable for the cap body 10 to be comprised of a comparably harder material than that of the snap-in chamber 20 and its constituent components. This provides a rigid engagement of the cap body with a container while also improving the ease of which the actuator 26 can be activated by a user. To that end, because the cap body 10 is hard in certain embodiments, the softer snap-in chamber 20 and its actuator 26 will be more easy to activate because it has a harder supporting, non-moving piece to engage against, i.e. the cap body 10. The capsule may also be sized and shaped to accommodate fitment on any desired container 40 such as bottles, IV bags, pouches, and the like.

Furthermore, the threaded engagement with the container may be substitute for various snap-on or other releasable fitments known in the art.

It is further appreciated that the sealing member 30 may comprise a variety of plastic and foil-like materials. In some embodiments, sealing member 30 comprises a thin plastic or resin material having one or more lines of weakening to allow for dispensing of the first ingredient. In other embodiments, the sealing member 30 may comprise a foil or paper material equally suitable to be broken by the plunger action described above. In some embodiments, the sealing member 30 is a discrete component that are heat sealed, glued, or otherwise attached to the snap-in chamber 20. In other embodiments, the sealing member 30 is coextensively integrated into the chamber 20 but otherwise include lines of weakening or comprises a thin enough or breakable enough material such that the seal breaks under the pressure of lower cutting surface at the bottom of the plunger.

It is appreciated that the storage space 22 of the chamber 20 can contain any liquid, powder and or gasses and or micro/nano encapsulation in any combination desired. The dispensing capsule can be mounted or applied at any location of a container 40 including a bottle, pouch, can, IV bag, drum or tote. In some embodiments, the capsule is suited to be received on the threaded opening of such containers in order to provide a leak-free fitment. The chamber 20 of the dispensing capsule stores any desired ingredient and it and the cap body may be dimensioned as desired to fit a variety of applications. The size and shape of the capsule of the present invention should not be construed as limited to the sizes and shapes shown in the drawings herein. Rather, the volume of the chamber and the diameter of the various components can vary as desired and/or can vary depending on the size and shape of the intended container or other parameters. Further, the chamber need not be filled completely, but rather can accept any volume of an ingredient desired depending on mixing parameters and the desired final product.

By way of example only, the device can be used for drinks, hair care, pet products, drugs, over the counter medications, cleaning products, beverages, soups, dressings, nitrogen, fuels and engine cleansing, oils, waxes, pH enhancers, oral care, oxygen, adhesives and other categories of use depending on the ingredients and formulas. It is appreciated that the dispensing capsule allows for on-demand dispensing of a product or component of a product for mixing with another ingredient or ingredients in the container to which it is attached. It also provides a means to access or drink directly from the container 4 without needing to remove the capsule first. Also a coating of any type of moisture absorbent can be applied to the inside of the chamber to act as a desiccant and allow for moisture absorption of any excess moisture that may be contained inside the invention when filled and sealed.

Due to the encapsulated capsule excluding the sealing area the invention allows the ingredients to remain moisture free and have an unusually long shelf life and allowing with the sealed chamber to combine liquids and powders and oils and other ingredients to be sealed and stored separately if desired to prevent any reaction with one another. Also the device can include multiple applicators such as drinking spouts, pouring spouts and removable dosing cap for use of a product with one or more multiple chambers and plungers that have flow through to allow dispersing of all ingredients into a desired container. The exact configuration of such spouts and applications is not limited only to those designs shown in figures herein.

The instant invention has been shown and described herein in what is considered to be the most practical and preferred embodiments. It is recognized, however, that departures may be made therefrom within the scope of the invention and that obvious modifications will occur to a person skilled in the art.

What is claimed is:

1. A dispensing capsule, comprising:

a cap body having an annular exterior rim, said rim having an internal recess including an annular interior surface having threads for attaching the cap body to a primary container having a threaded opening;

said cap body internal recess including an annular protrusion for engaging a separate chamber;

a cylindrically shaped chamber removably snapped into said internal recess protrusion of said cap body, said chamber having an annular recess sized to engage and firmly attach said cap body protrusion to said chamber recess;

said snap in chamber including a flexible actuator and a sealing member sealing a lower portion of said chamber;

a hollow plunger discrete from said chamber and slidingly disposed within said chamber, wherein a top portion of said hollow plunger engages the underside of said flexible actuator of said chamber, and wherein said hollow plunger is resiliently retained in said chamber to prevent said plunger from dislodging from said chamber upon activation of said capsule; and wherein said flexible actuator of said chamber is configured to deform and engage said hollow plunger, causing a distal end of said hollow plunger to puncture said sealing member, dispensing an ingredient stored in said chamber.

2. The dispensing capsule of claim 1, wherein said flexible actuator comprises a bellow-type actuator.

3. The dispensing capsule of claim 1, wherein said hollow plunger includes at said top portion thereof, a nozzle.

4. The dispensing capsule of claim 1, wherein said plunger includes one or more aeration openings.

5. The dispensing capsule of claim 1, further include a cover removably received on said cap body.

6. The dispensing capsule of claim 5, wherein said cover is hingeably attached to said cap body.

7. The dispensing capsule of claim 1, wherein said chamber includes two circumferentially disposed races defining an annular groove.

8. The dispensing capsule of claim 1, wherein said chamber is comprised of a softer material than said cap body.

9. The dispensing capsule of claim 8, wherein said material of said chamber and said cap body is plastic.

10. The dispensing capsule of claim 1, wherein said distal end of said hollow plunger comprises a beveled cutting surface.

* * * * *